US005592758A

United States Patent [19]

Iwama et al.

[11] Patent Number: 5,592,758

[45] Date of Patent: Jan. 14, 1997

[54] SKI BOOT WITH OVERLAPPING INSTEP PORTIONS

[75] Inventors: Shinichi Iwama; Seiki Ota; Keiji Tsugami, all of Tokyo, Japan

[73] Assignee: Daiwa Seiko, Inc., Tokyo, Japan

[21] Appl. No.: 172,897

[22] Filed: Dec. 27, 1993

[30] Foreign Application Priority Data

Dec. 28, 1992 [JP] Japan ..... 4-348801

[51] Int. Cl.[6] ..... A43B 5/04

[52] U.S. Cl. ..... 36/117.1; 36/54

[58] Field of Search ..... 36/113–121, 109, 36/54, 50.1, 50.5, 83, 45, 88, 89

[56] References Cited

U.S. PATENT DOCUMENTS

| | | | |
|---|---|---|---|
| 3,217,371 | 11/1965 | Collins | 36/50.1 |
| 4,934,074 | 6/1990 | Sartor | 36/119 |
| 4,936,295 | 6/1990 | Crane | 36/89 |
| 5,031,340 | 7/1991 | Hilgarth | 36/117 |
| 5,272,823 | 12/1993 | Perrissoud | 36/118 |

FOREIGN PATENT DOCUMENTS 4-226601 8/1992 Japan .

*Primary Examiner*—Thomas P. Hilliard
*Attorney, Agent, or Firm*—Longacre & White

[57] ABSTRACT

A ski boot which can improve the insertion and removal of a skier's foot, provide an excellent fastening feeling by fastening members, enhance the durability of a connecting portion between a cover member and a shell main body, and eliminate the possibility of water leakage. A slit is formed in the upper portion of separated & overlapping portions of a shell main body separated right and left and extending from an upper opening to an instep area of the shell main body. The slit and separated & overlapping portions are covered with a cover member from the toe portion of the shell main body to the upper opening thereof. A plurality of fastening members are used to fasten a trunk portion to be inclinably mounted to the shell main body as well as fasten the separated & overlapping portions. The fastening members for fastening the separated & overlapping portions of the shell main body are mounted directly to the shell main body and the cover member is connected to the shell main body before and after the fore-most fastening member situated on the toe side among the fastening members mounted to the shell main body.

13 Claims, 5 Drawing Sheets

SKI BOOT WITH OVERLAPPING INSTEP PORTIONS

BACKGROUND OF THE INVENTION

The present invention relates to a ski boot and, in particular, an improvement in a ski boot of a front buckle type.

Conventionally, in a ski boot of a front buckle type, as disclosed in Japanese Patent Publication No. 4-226601 of Heisei, in order to facilitate the insertion and removal of a skier's foot, there is formed a slit in the upper section of separated & overlapping portions of a shell main body separated right and left in a manner to extend from an upper opening of the shell main body to an instep area thereof, and there is provided a cover member for covering the slit as well as the separated & overlapping portions in such a manner that it extends from a toe portion of the shell main body to the upper opening thereof.

However, in the above-mentioned conventional ski boot, as shown in FIG. 9, since it employs such a structure that the separated & overlapping portions 3 of the shell main body 1 separated right and left are fastened by a plurality of buckles 7 respectively mounted to the cover member 5, when the separated overlapping portions 3 (instep area) are fastened by the buckles 7, there is produced a space 9 between the shell main body 1 and cover member 5, which results in an insufficient fastening effect.

Also, in the conventional boot structure, the cover member 5 can be pivotally moved with respect to the shell main body 1 about its connecting point positioned on the toe portion of a ski boot 11. Further, in the structure of the ski boot 11, a pin 13 mounted to the instep area of the shell main body 1 is engageable with an elongated hole 15 of a cover member 5 formed in the neighborhood of a second buckle 7*a* to thereby prevent slipping of the cover member 5 and also, when the separated & overlapping portions 3 are fastened by the buckles 7, the cover member 5 is arranged in such a manner that it does not interfere with such fastening.

However, because the cover member 5 is connected through the pin 13 to the shell main body 1 in the neighborhood of the second buckle 7*a*, the angle of forward opening of the cover member 5 is so small that the foot insertion and removal cannot be achieved sufficiently. Also, the provision of the elongated hole 15 in the cover member 5 produces a possibility that water may be leaked into the ski boot from the elongated hole 15 and a great load is given to the elongated hole 15 by the pin 13 when fastening, which has an ill effect on the durability of the elongated hole 15 when it is used for a long period of time.

In FIG. 9, reference character 17 designates a cable, one end of which is connected to one separated portion 3*a*. The cable 17 is connected to the buckles 7 through a through hole 19 which is formed in the shell main body 1.

SUMMARY OF THE INVENTION

The present invention aims at eliminating the drawbacks found in the above-mentioned conventional ski boot. Accordingly, it is an object of the invention to provide a ski boot which can improve the insertion and removal of a skier's foot and the fastening feeling by a fastening member, can improve the durability of a connecting portion between a cover member and a shell main body, and can provide a sufficient measure to meet water leakage.

In achieving the above object, according to the invention, there is provided a ski boot which includes a slit formed in the upper portion of separated & overlapping portions of a shell main body respectively separated right and left so as to extend from an upper opening of a shell main body to an instep area thereof, a cover member for covering the slit as well as the separated & overlapping portions from the toe portion of the shell main body to the upper opening thereof, and a plurality of fastening members for fastening the separated & overlapping portions and a trunk portion to be inclinably mounted to the shell main body, wherein the fastening members for fastening the separated & overlapping portions of the shell main body are mounted directly to the shell main body and the cover member is connected to the shell main body before and after one of the fastening members mounted to the shell main body, which is situated in the fore-most position in the toe portion of the ski boot.

If the fastening by the respective fastening members is removed to thereby develop the cover member forwardly, then the cover member is opened widely with its connecting portion in the rear portion of the fore-most fastening member situated in the toe portion of the ski boot as the boundary thereof, so that the slit formed in the upper opening of the shell main body can be opened widely. And, to insert a skier's foot into the ski boot and fasten the ski boot, if the separated & overlapping portions of the shell main body and slit are covered with the cover member and the separated & overlapping portions of the shell main body and the separated & overlapping portions of the trunk portion are respectively fastened by means of the fastening members, then the cover member is pressed against the shell main body to thereby be able to fasten the separated & overlapping portions of the shell main body and the slit together without producing any clearance.

Also, according to the invention, there is provided a ski boot which includes a slit formed in the upper portion of separated & overlapping portions of a shell main body respectively separated right and left so as to extend from an upper opening of a shell main body to an instep area thereof, a cover member for covering the slit and the separated & overlapping portions from the toe portion of the shell main body to the upper opening thereof, and a plurality of fastening members for fastening the separated & overlapping portions and a trunk portion to be inclinably mounted to the shell main body, wherein the fastening members for fastening the separated & overlapping portions of the shell main body are mounted directly to the shell main body, the cover member is connected to the toe portion of the shell main body, and the cover member is connected to the instep are of the shell main body through engaging pins respectively to be mounted to either of the shell main body or cover member, each of engaging pins having a head portion, as well as through engaging members respectively to be mounted to either of the shell main body or the other side of the cover member, the engaging members respectively corresponding to the engaging pins, with which the head portions of the engaging pins are slidably engageable in such a manner that they are prevented against slippage.

When the ski boot is fastened by the fastening members and the fastening of the ski boot is removed, the head portions of the engaging pins slides the engaging member, so that the cover member will never provide any obstacle to the fastening of the separated & overlapping portions.

DETAILED DESCRIPTION OF THE PREFERRED EMBODIMENT

Description will be given hereinbelow in detail of an embodiment of a ski boot according to the invention with reference to the accompanying drawings.

Figure 1:
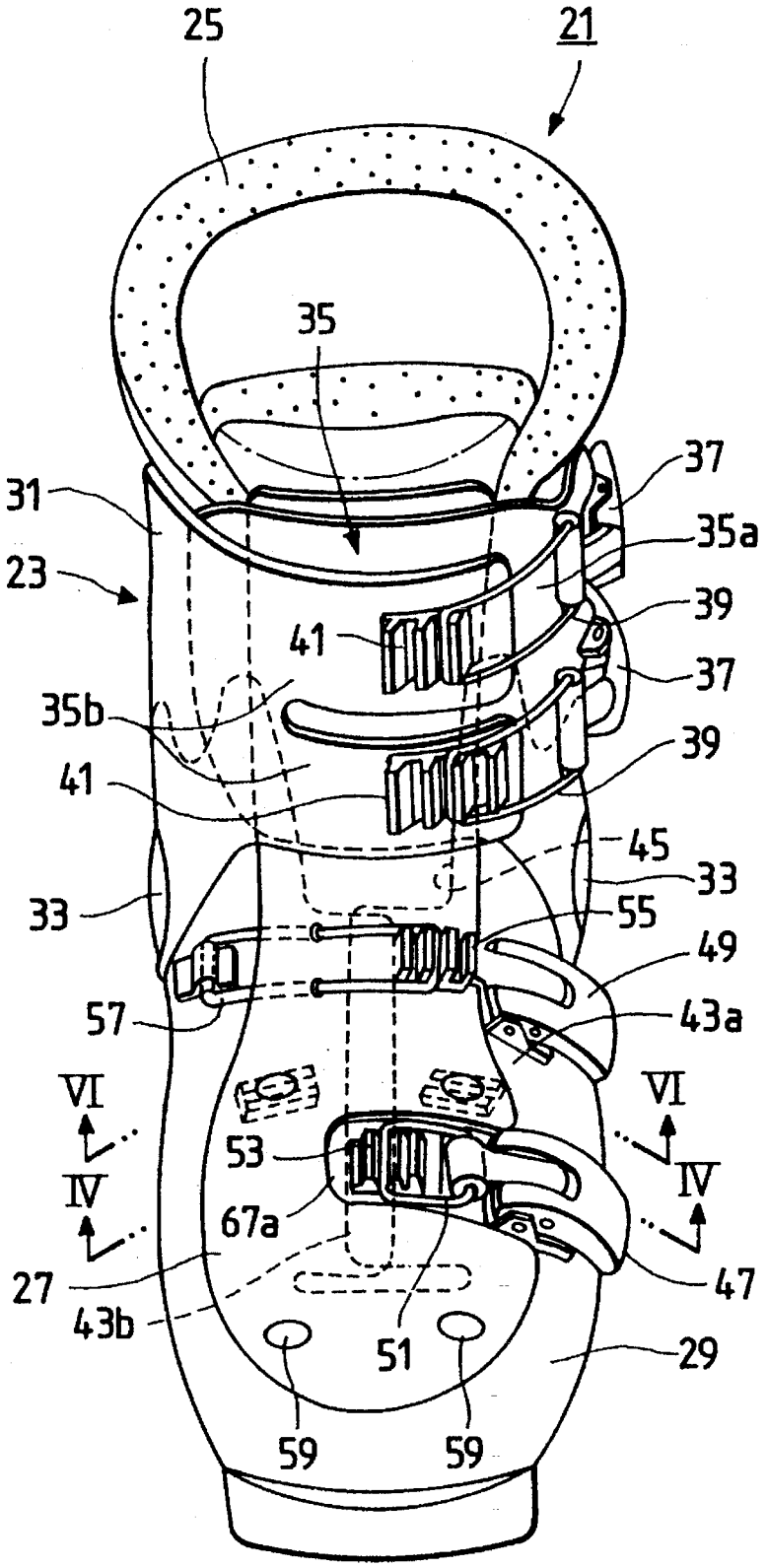
FIG. 1 is a perspective view of the front side of a ski boot according to an embodiment of the invention.

In FIG. 1, reference character 21 designates a ski boot which is constructed according to an embodiment of the invention. The ski boot 21 includes an outer shell 23 formed of a hard and strong plastic material such as polyurethane or the like, an inner boot 25 mounted within the outer shell 23, and a cover member 27 which is used to cover the front surface portion of the outer shell 23.

The outer shell 23 includes a shell main body 29 for covering mainly a skier's foot including the ankle of the skier, and a trunk portion 31 for covering the lower front and rear portions of the skier's leg integrally. The trunk portion 31 has a lower end portion which is mounted to the shell main body 29 by means of pins 33, so that the trunk portion 31 can be inclined back and forth according to the forwardly inclining positions of the skier.

And, likewise in the conventional ski boot, the front portion of the trunk portion 31 is separated right and left to provide separated & overlapping portions 35 which are overlapping on each other. One separated portion 35*a* has two buckles 37 which are respectively mounted fixedly to the upper and lower portions of the separated portion 35*a*. Two fastening cables 39 are respectively mounted to the respective buckles 37. If the fastening cables 39 are respectively engaged with engaging members 41 respectively fixed to the opposite-side separated portion 35*b* to operate the buckles 37, then the separated & overlapping portions 35 of the trunk portion 31 can be fastened.

Figure 2:
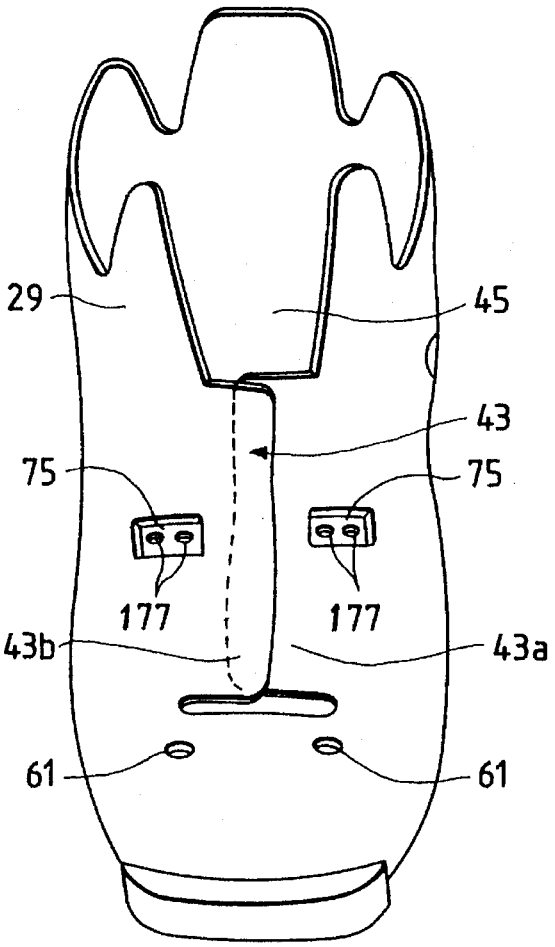
FIG. 2 is a perspective view of the front side of a shell main body employed in the invention.

Also, the shell main body 29, as shown in FIG. 2, is separated right and left over a portion thereof extending from an upper opening thereof to an instep area thereof, thereby providing two separated & overlapping portions 43 which are overlapping on each other. In the upper portion of the separated & overlapping portion 43, that is, in the front surface portion of the upper opening, there is formed a slit 45 which extends longitudinally of the shell main body 29 so as to facilitate the insertion and removal of a skier's foot. And, two fastening buckles 47, 49 are respectively mounted directly at the front and rear positions of one (that is, 43*a*) of the separated & overlapping portions 43. Thus, by engaging a fastening cable 51, which is mounted to the fore-most first buckle 47 situated on the toe side, with an engaging member 53 fixed to the other separated portion 43*b* to operate the first buckle 47, the toe-side instep portion of the shell main body 29 can be fastened. Also, on the separated portion 43, there is directly mounted a fastening cable 57 which can be engaged with an engaging member 55 mounted to the buckle 49. If the fastening cable 57 is engaged with the engaging member 55 to operate the buckle 49, then the ankle-side instep portion of the shell main body 29 can be fastened.

And, on the shell main body 29, there is mounted a cover member 27 which is used to cover the separated & overlapping portions 43 as well as the slit 45 from the toe-side to the upper opening of the shell main body 29.

Figure 3:
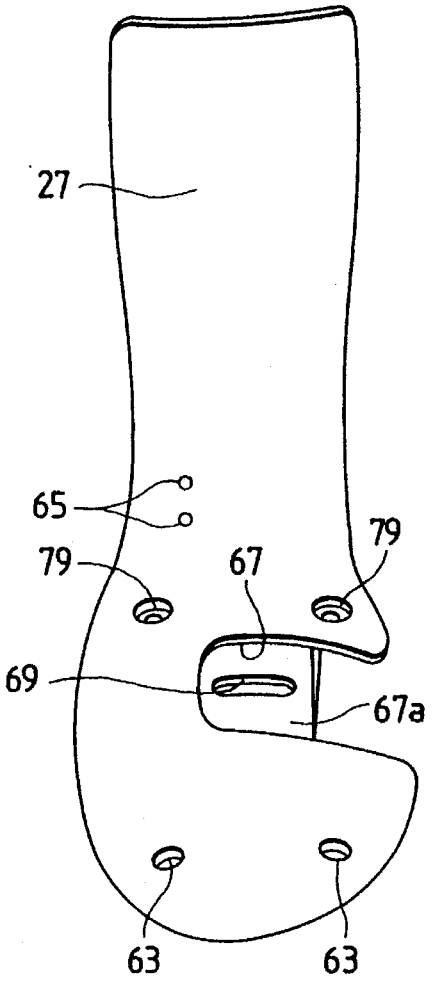
FIG. 3 is a perspective view of the front side of a cover member employed in the invention.

The cover member 27, as shown in FIG. 3, is a ladle-shaped tongue piece member, the leading end side of which is formed wide in width so as to extend along the leading end shape of the shell main body 29. The cover member 27 is formed of the same material as the outer shell 3 and has a shape substantially identical with the front surface portion of the shell main body 29. And, the cover member 27 is mounted at the two leading end side positions thereof to the toe-side portion of the shell main body 29. Here, in FIGS. 2 and 3, reference characters 61, 63 respectively designate mounting holes which are used to mount pins 59 respectively formed in the shell main body 29 and cover member 27.

Figure 4:
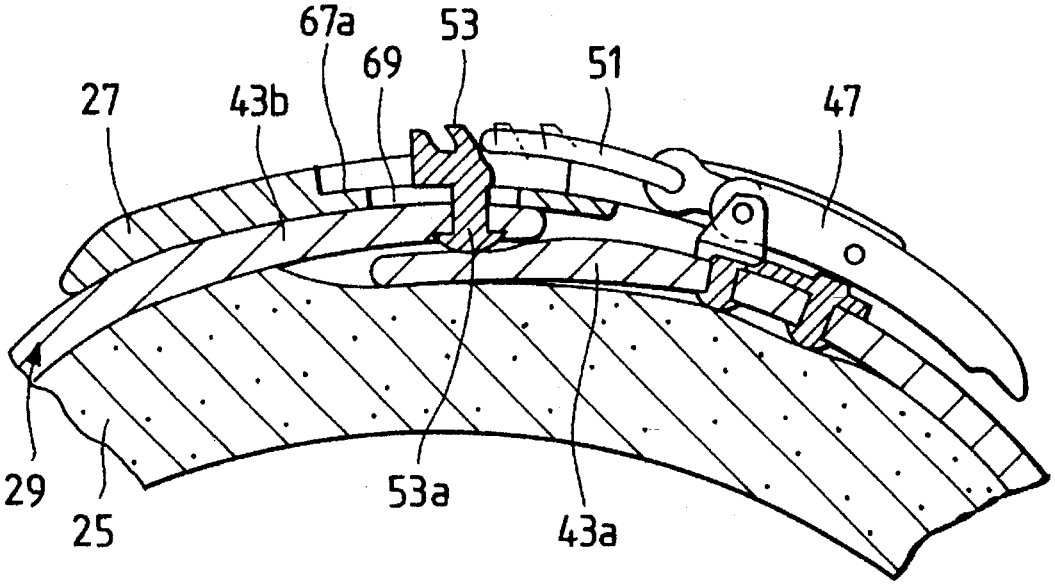
FIG. 4 is a section view taken along the line IV—IV shown in FIG. 1.

Also, as shown in FIG. 3, in the cover member 27, there are formed two through holes 65, through which the fastening cable 57 to be mounted to the separated portion 43*b* extends, and a recessed portion 67 which is used to dispose the engaging member 53 onto the cover member 27. And, as shown in FIGS. 3 and 4, in the bottom portion 67*a* of the recessed portion 67, there is formed an elongated hole 69 extending along the direction in which the separated & overlapping portions are fastened by the first buckle 47, and the mounting shaft portion 53*a* of the engaging member 53 to be mounted to the separated portion 43*b* is to be inserted through the elongated hole 69, so that, when the two separated portions 43*a* and 43*b* are fastened by the first buckle 47, the cover member 27 never provides any obstacle to such fastening.

Further, the cover member 27 is connected to the shell main body 29 at the two rear positions thereof in the neighborhood of the first buckle 47.

Figure 5:
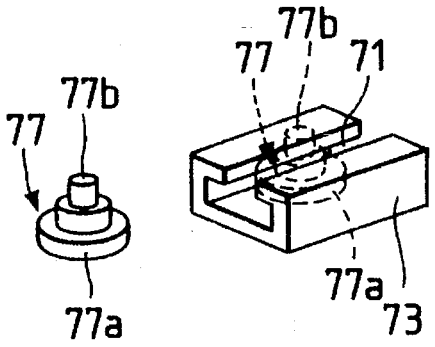
FIG. 5 is a perspective view of an engaging pin and an engaging member.
Figure 6:
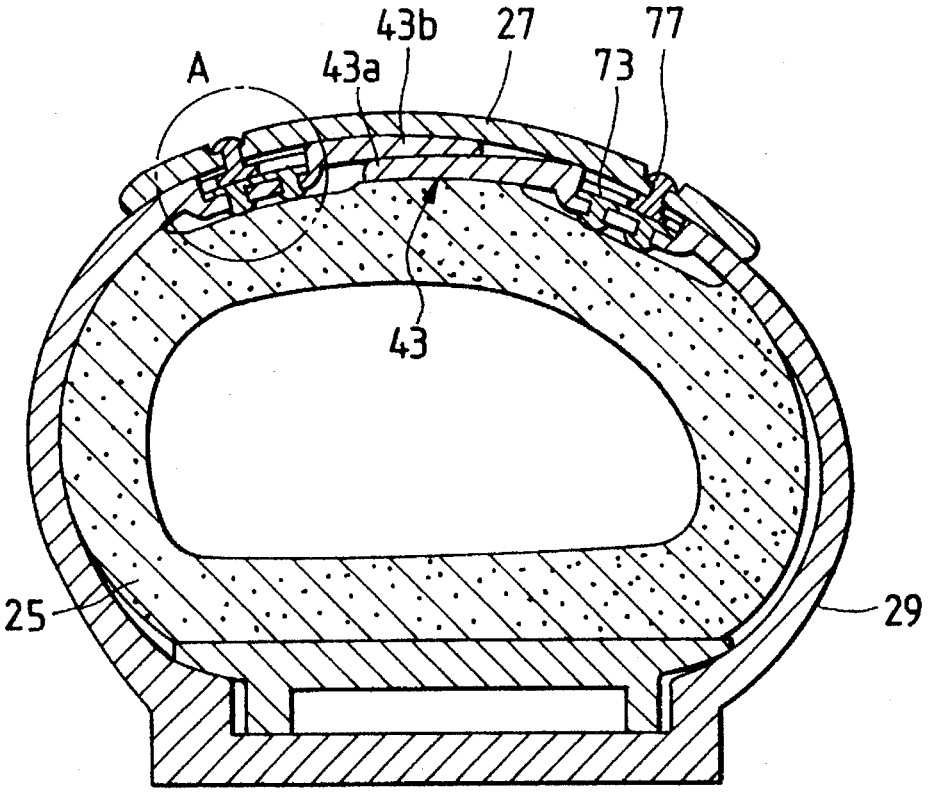
FIG. 6 is a section view taken along the line VI—VI shown in FIG. 1.
Figure 7:
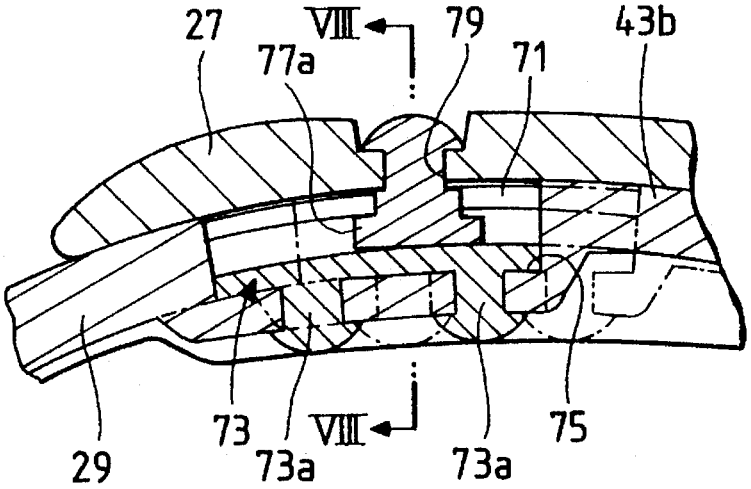
FIG. 7 is an enlarged view of an A portion shown in FIG. 6.
Figure 8:
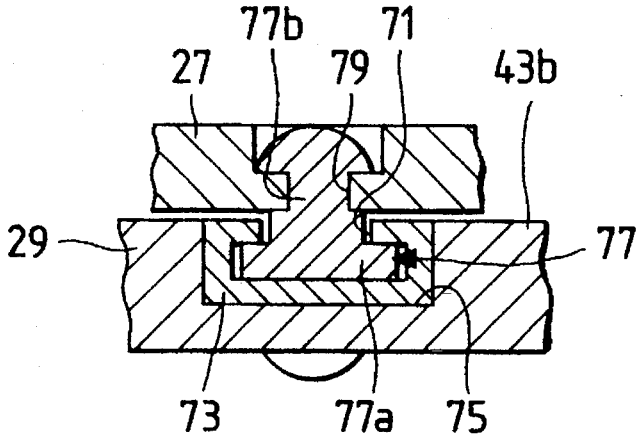
FIG. 8 is a section view taken along the line VIII—VIII shown in FIG. 7.

That is, as shown in FIG. 2, in the two separated portions 43*a*, 43*b* of the shell main body 29, there are formed recessed portions 75 each of which is used to fix an engaging member 73 (FIG. 5) of a substantially C-like section including a guide slit 71 on the upper surface thereof. And, as shown in FIGS. 6 to 8, the respective engaging members 73 are mounted through mounting shaft portions 73*a* to mounting holes 177 respectively formed in the recessed portions 75, so that upper surfaces of the engaging members 73 are flush with the shell main body 29, and the guide slits 71 extend in the fastening direction of the separated & overlapping portions 43.

On the other hand, correspondingly in location to the respective engaging members 73, engaging pins 77 are mounted to the cover member 27. The head portion 77*a* of each of the engaging pins 77 is slidably engaged into the guide slit 71 of each of the engaging members 73 so that the engaging pins 77 are prevented from being removed from the engaging member 73. Thus, when the separated & overlapping portions 43 are fastened by the buckles 47 and 49, the respective head portions 77*a* of the engaging pins 77 are slid within the guide slits 71 to thereby prevent the cover member 27 from interfering with the fastening of the separated & overlapping portions 43.

The above engaging pins 77 are mounted to the cover member 27 by inserting their mounting shaft portions 77*b* through engaging pin mounting holes 79 formed in the cover member 27 and then by flattening the leading ends thereof which project out from the cover member 27.

Since the ski boot 21 according to the present embodiment is structured in the above-mentioned manner, if the fastening by the respective buckles 37, 47 and 49 is removed to thereby develop the cover member 27 forwardly, then the cover member 27 is opened wide with its connecting portion between the engaging member 73 and engaging pin 77 as the boundary thereof, whereby the slit 45 is greatly opened, which is formed in the upper opening of the shell main body 29.

To insert a skier's foot into the ski boot 21 and fasten the ski boot 21, the separated & overlapping portions 43 and slit 45 of the shell main body 29 are covered with the cover member 27 and then the separated & overlapping portions 43 of the shell main body 29 and the separated & overlapping portions 31 of the trunk portion 31 are respectively fastened by the buckles 37, 47 and 49, so that the cover member 27 can be pressed against the shell main body 29 to thereby fasten the separated & overlapping portions 43 of the shell main body 29 and slit 45 without any clearance.

And, when the ski boot is fastened or the fastening of the ski boot is removed by the buckles 47, 49, the head portions 77*a* of the engaging pins 77 are slid within the guide slits 71 of the engaging members 73 respectively so that the cover member 27 never provides any obstacle to the movements of the separated portions 43*a* and 43*b*.

Figure 9:
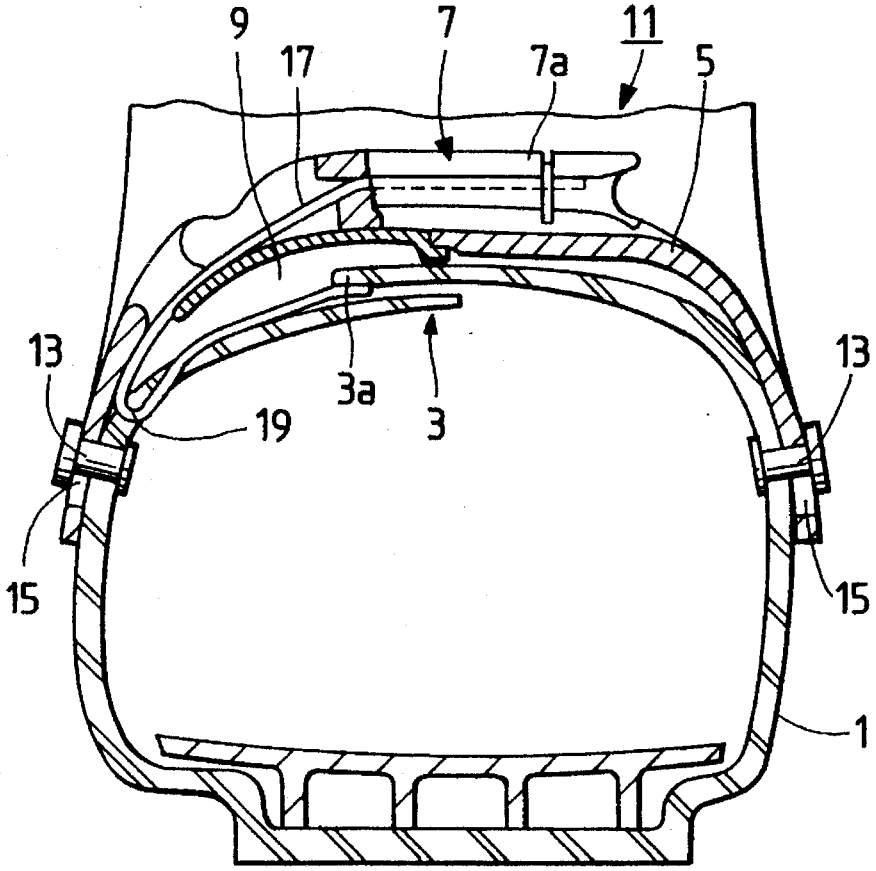
FIG. 9 (PRIOR ART)
FIG. 9 is a section view of a shell main body and a cover member respectively employed in a conventional ski boot.

As described above, unlike the conventional ski boot shown in FIG. 9, in the present embodiment, due to the fact that the buckles 47, 49 for fastening the separated & overlapping portions 43 of the shell main body 29, the engaging members 53, 55 and the fastening cables 57 to be engaged with the engaging members 53, 55 are mounted directly to the shell main body 29, when the separated & overlapping portions 43 are fastened by the buckles 47, 49, as shown in FIGS. 4 and 6, no space can be produced between the shell main body 29 and the cover member 27 so that the fastening effect of the ski boot by the buckles 47, 49 can be improved when compared with the conventional ski boot shown in FIG. 9.

Also, as described before, according to the structure of the cover member 5 employed in the conventional ski boot shown in FIG. 9, since the cover member 5 is connected through the pin 13 to the shell main body 1 in the neighborhood of the second buckle 7*a*, the angle of forward opening of the cover member 6 is small so that the insertion and removal of a foot into and from the ski boot cannot be achieved sufficiently. On the other hand, according to the present embodiment, because the cover member 27 is connected to the shell main body 29 at the two rear positions thereof in the neighborhood of the first buckle 47, the cover member 27 can be opened more widely than the conventional ski boot, with the result that the insertion and removal of the foot can be improved.

Further, in the above-mentioned conventional ski boot, in order that, when the separated & overlapping portions 3 are fastened by the buckles 7, the cover member 5 does not provide any obstacle to the fastening, there are formed the elongated holes 15 which allow the cover member 5 to slide with respect to the separated & overlapping portions 3. However, the provision of the elongated holes 15 in the cover member 5 can produce a possibility that water can be leaked in from the elongated holes 15. Also, when fastening, excessive loads can be applied to the elongated holes 15 due to the pins 13, which worsens the durability of the elongated holes 15 when they are used for a long period of time. On the other hand, according to the present embodiment, due to the fact that the engaging pins 77 each having a head portion 77*a* are provided on the shell main body 29, the engaging members 73 are provided on the shell main body 29 correspondingly to the engaging pins 77 with which the head portions 77*a* of the engaging pins 77 can be slidably engaged for prevention of removal, and the cover member 27 is connected to the shell main body 29 at the two rear positions in the neighborhood of the first buckle 47 by means of the engaging pins 77 and engaging members 73, the durability and strength of the connecting portions can be improved as well as the possibility of generation of water leakage can be eliminated, which are the advantages of the present embodiment over the conventional ski boot.

In the above-mentioned embodiment, the engaging pins 77 are provided on the shell main body 29 and the engaging members 73 are provided correspondingly to the engaging pins 77 on the shell main body 29, with which the head portions 77*a* of the engaging pins 77 can be slidably engaged for prevention of slippage. However, alternatively, the engaging members 73 can be mounted to the back surface side of the cover member 27 and the engaging pins 77 can be mounted to the shell main body 29. The last-mentioned structure can also achieve the desired object of the invention likewise as in the illustrated embodiment of the invention.

As has been described heretofore, according to the inventions as set forth in the respective claims, when compared with the conventional ski boot, the foot insertion and removal can be improved, a good fastening feeling by the fastening device can be obtained, the durability of the connecting portion between the cover member and shell main body can be enhanced, and a possibility of water leakage into the ski boot can be eliminated.

What is claimed is:

1. A ski boot comprising:

a shell main body having a trunk portion defining a foot insertion opening, separated and overlapping portions separated from and adapted to be overlapped with each other and located at an instep area of said main body, and a slit located between each of said separated and overlapping portions and said foot insertion opening;

a cover laid from a toe portion of said main body to said foot insertion opening for covering said slit and said separated and overlapping portions; and a plurality of fastening members pivotally mounted to fasten said trunk portion and said separated and overlapping portions, wherein:

at least one fastening member for fastening said separated and overlapping portions is pivotally mounted directly to said shell main body, and pivots between a first loosened position and a second fastened position;

wherein said first part has a mounting shaft fixedly received by a through-hole formed in one of said separated and overlapping portions, a distal, axial end of said mounting shaft is located between said first and second portions.

2. The ski boot according to claim 1, wherein said at least one fastening member includes a first part and a second part mating with said first part in said fastened position, said first part being fixedly secured to a first portion of said separated and overlapping portions and said second part being fixedly secured to a second portion of said separated overlapping portions, said first and second portions being relatively moveable with respect to each other.

3. The ski boot according to claim 2, wherein a first relative motion between said first part and said first portion and a second relative motion between said second part and said second portion are prevented in said fastened position.

4. The ski boot according to claim 1, wherein said mounting shaft passes through an elongated hole formed in said cover.

5. The ski boot according to claim 1, wherein said plurality of fastening members comprise a first fastening member proximate said toe portion and a second fastening member adjacent said first fastening member and located at a position opposite said first fastening member with respect to said toe portion, and wherein said cover is connected to said shell main body between the first fastening member and said toe portion and between said first and second fastening members.

6. The ski boot according to claim 1, wherein said cover is connected to said instep area of said main body by means of at least one engaging pin and at least one corresponding engaging member, said engaging pin having a head portion and being mounted on a first one of said main body and said cover, and said engaging member slidably receiving said head portion and being mounted on a second one of said main body and said cover.

7. A ski boot comprising:

a shell main body having a trunk portion defining a foot insertion opening, separated and overlapping portions separated from and adapted to be overlapped with each other and located at an instep area of said main body, and a slit located between each of said separated and overlapping portions and said foot insertion opening;

a cover laid from a toe portion of said main body to said foot insertion opening for covering said slit and said separated and overlapping portions; and a plurality of fastening members pivotally mounted to fasten said trunk portion and said separated and overlapping portions, wherein:

said cover is connected to said instep area of said main body by means of at least one engaging pin and at least one corresponding engaging member, said engaging pin having a head portion and being mounted on said cover, and said engaging member slidably receiving said head portion and being mounted on said main body;

wherein said at least one fastening member includes a first part and a second part mating with said first part in said fastened position, said first part being fixedly secured to a first portion of said separated and overlapping portions and said second part being fixedly secured to a second portion of said separated and overlapping portions, said first and second portions being relatively moveable with respect to each other.

8. The ski boot according to claim 7, wherein said plurality of fastening members comprise a first fastening member proximate said toe portion and a second fastening member adjacent said first fastening member and located at a position opposite said first fastening member with respect to said toe portion, and wherein said cover is connected to said shell main body between the first fastening member and said toe portion and between said first and second fastening members.

9. The ski boot according to claim 7, wherein said cover is fixedly connected to said toe portion of said main body.

10. The ski boot according to claim 7, wherein a first engaging pin and corresponding first engaging member are provided to connect said cover to a first portion of said separated and overlapping portions, and a second engaging pin and corresponding second engaging member are provided to connect said cover to a second portion of said separated and overlapping portions, said first portion being adapted to move relative to said second portion.

11. The ski boot according to claim 8, said engaging member includes a relatively flat base defining a first side and second side opposite from said first side, a mounting shaft protruded from said first side, and standing walls protruded from said second side to define a guide groove slidably receiving said head portion, and said mounting shaft is fixedly secured to a through-hole of said main body so that said first side closely contacts with a surface of said main body around said through-hole to prevent water from entering said through-hole.

12. The ski boot according to claim 7, wherein said cover is slidably movable with respect to said plurality of fastening members used to fasten said separated and overlapping portions.

13. The ski boot according to claim 12, wherein each of said separated and overlapping portions is an integral portion of said main body.

* * * * *